US008395320B2

(12) United States Patent
Mizokami et al.

(10) Patent No.: US 8,395,320 B2
(45) Date of Patent: Mar. 12, 2013

(54) PLASMA DISPLAY PANEL

(75) Inventors: Kaname Mizokami, Kyoto (JP); Hideji Kawarazaki, Osaka (JP); Yoshinao Ooe, Kyoto (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/593,089

(22) PCT Filed: Dec. 2, 2008

(86) PCT No.: PCT/JP2008/003550

§ 371 (c)(1),
(2), (4) Date: Sep. 25, 2009

(87) PCT Pub. No.: WO2009/075072

PCT Pub. Date: Jun. 18, 2009

(65) Prior Publication Data

US 2010/0060163 A1 Mar. 11, 2010

(30) Foreign Application Priority Data

Dec. 13, 2007 (JP) ..... 2007-321836

(51) Int. Cl.
*H01J 17/49* (2012.01)

(52) U.S. Cl. ..... 313/582; 313/586

(58) Field of Classification Search ..... 313/582–586
See application file for complete search history.

(56) References Cited

U.S. PATENT DOCUMENTS 6,753,649 B1 6/2004 Bechtel et al.
6,753,694 B2 6/2004 Eaton
7,196,472 B2 3/2007 Hasegawa et al.
7,501,763 B2 3/2009 Hashimoto et al.
7,759,868 B2 7/2010 Naoi et al.

(Continued)

FOREIGN PATENT DOCUMENTS

CN 1965385 5/2007
EP 1 557 857 7/2005

(Continued)

OTHER PUBLICATIONS

Supplementary European Search Report issued Feb. 25, 2010 in EP 08 85 8388.

(Continued)

*Primary Examiner* — Joseph L Williams
*Assistant Examiner* — Brenitra M Lee
(74) *Attorney, Agent, or Firm* — Wenderoth, Lind & Ponack, L.L.P.

(57) ABSTRACT

A plasma display panel (PDP) includes a front panel including (i) a substrate, (ii) a display electrode formed on the substrate, (iii) a dielectric layer formed to cover the display electrode, and (iv) a protective layer formed on the dielectric layer. Further, the PDP includes a rear panel disposed facing the front panel forming a discharge space, and including an address electrode formed in a direction intersecting the display electrode and a barrier rib partitioning the discharge space. The protective layer is formed by forming a base film of MgO on the dielectric layer and attaching a plurality of aggregated particles of metal oxide crystal particles to the base film so that the aggregated particles are distributed over the entire surface, the base film includes Si as a material impurity, and a Si concentration in the base film is more than 0 ppm and not more than 10 ppm.

2 Claims, 5 Drawing Sheets

U.S. PATENT DOCUMENTS

| | | | | |
|---|---|---|---|---|
| 7,812,534 | B2 | 10/2010 | Yamamoto et al. | |
| 2004/0070341 | A1* | 4/2004 | Chul Park | 313/582 |
| 2005/0253519 | A1 | 11/2005 | Hasegawa et al. | |
| 2005/0258753 | A1* | 11/2005 | Hasegawa et al. | 313/586 |
| 2005/0264211 | A1 | 12/2005 | Kim | |
| 2006/0055324 | A1 | 3/2006 | Hasegawa et al. | |
| 2006/0284559 | A1* | 12/2006 | Naoi et al. | 313/586 |
| 2007/0216302 | A1 | 9/2007 | Hashimoto et al. | |
| 2008/0157673 | A1* | 7/2008 | Fukui et al. | 313/587 |
| 2008/0278074 | A1 | 11/2008 | Yamamoto et al. | |
| 2009/0146566 | A1 | 6/2009 | Fukui et al. | |
| 2009/0167176 | A1 | 7/2009 | Fukui et al. | |
| 2010/0213818 | A1 | 8/2010 | Naoi et al. | |

FOREIGN PATENT DOCUMENTS

| | | |
|---|---|---|
| EP | 1 587 126 | 10/2005 |
| EP | 1 657 735 | 5/2006 |
| EP | 2 031 629 | 4/2009 |
| JP | 11-339665 | 12/1999 |
| JP | 2001-118511 | 4/2001 |
| JP | 2002-260535 | 9/2002 |
| JP | 2006-59779 | 3/2006 |
| JP | 2006-244784 | 9/2006 |
| JP | 2007-35655 | 2/2007 |
| JP | 2007-48733 | 2/2007 |
| JP | 2007-48734 | 2/2007 |
| JP | 2007-138198 | 6/2007 |
| JP | 2008-293803 | 12/2008 |
| KR | 2005-0004918 | 1/2005 |
| KR | 2006-0056869 | 5/2006 |
| KR | 2007-0015942 | 2/2007 |
| WO | 2005/098890 | 10/2005 |
| WO | 2007/139184 | 6/2007 |
| WO | 2007/126061 | 11/2007 |

OTHER PUBLICATIONS

International Search Report issued Feb. 3, 2009 in International (PCT) Application No. PCT/JP2008/003550.

European Office Action issued Oct. 21, 2010 in Application No. 08 858 388.5.

European Office Action issued Sep. 9, 2011 in corresponding European Application No. 08 858 388.5.

* cited by examiner

PLASMA DISPLAY PANEL

This Application is a U.S. National Phase Application of PCT International Application PCT/JP2008/003550.

TECHNICAL FIELD

The present invention relates to a plasma display panel used in a display device, and the like.

BACKGROUND ART

Since a plasma display panel (hereinafter, referred to as a "PDP") can realize a high definition and a large screen, 65-inch class televisions are commercialized. Recently, PDPs have been applied to high-definition television in which the number of scan lines is twice or more than that of a conventional NTSC method. Meanwhile, from the viewpoint of environmental problems, PDPs without containing a lead component have been demanded.

A PDP basically includes a front panel and a rear panel. The front panel includes a glass substrate of sodium borosilicate glass produced by a float process; display electrodes each composed of striped transparent electrode and bus electrode formed on one principal surface of the glass substrate; a dielectric layer covering the display electrodes and functioning as a capacitor; and a protective layer made of magnesium oxide (MgO) formed on the dielectric layer. On the other hand, the rear panel includes a glass substrate; striped address electrodes formed on one principal surface of the glass substrate; a base dielectric layer covering the address electrodes; barrier ribs formed on the base dielectric layer; and phosphor layers formed between the barrier ribs and emitting red, green and blue light, respectively.

The front panel and the rear panel are hermetically sealed so that the surfaces having electrodes face each other. Discharge gas of Ne—Xe is filled in discharge space partitioned by the barrier ribs at a pressure of 400 Torr to 600 Torr. The PDP realizes a color image display by selectively applying a video signal voltage to the display electrode so as to generate electric discharge, thus exciting a phosphor layer of each color with ultraviolet ray generated by the electric discharge so as to emit red, green and blue light.

In such PDPs, the role of the protective layer formed on the dielectric layer of the front panel includes protecting the dielectric layer from ion bombardment by discharge, emitting initial electrons so as to generate address discharge, and the like. Protecting the dielectric layer from ion bombardment is an important role for preventing a discharge voltage from increasing. Emitting initial electrons so as to generate address discharge is an important role for preventing address discharge error that may cause flicker of an image.

In order to reduce flicker of an image by increasing the number of initial electrons emitted from the protective layer, an example in which an impurity is added to MgO and an example in which MgO particles are formed on an MgO protective layer are disclosed for instance (see, for example, Patent Documents 1, 2 and 3).

Recently, televisions have realized higher definition. In the market, low cost, low power consumption and high brightness full HD (high definition) (1920×1080 pixels: progressive display) PDPs have been demanded. Since an electron emission property from a protective layer determines an image quality of a PDP, it is very important to control the electron emission property.

An attempt to improve the electron emission property has been made by mixing an impurity in a protective layer. However, when the electron emission property is improved by mixing an impurity in the protective layer, electric charges are accumulated on the surface of the protective layer, thus increasing a damping factor, that is, reducing electric charges to be used as a memory function over time. Therefore, in order to suppress this it is necessary to take measures, for example, an applied voltage needs to be increased. Thus, a protective layer should have two conflicting properties, a high electron emission property and a high electric charge retention property, that is, a property of reducing a damping factor of electric charge as a memory function.

[Patent document 1] Japanese Patent Unexamined Publication No. 2002-260535

[Patent document 2] Japanese Patent Unexamined Publication No. H11-339665

[Patent document 1] Japanese Patent Unexamined Publication No. 2006-59779

SUMMARY OF THE INVENTION

A PDP of the present invention includes a front panel including a substrate, a display electrode formed on the substrate, a dielectric layer formed so as to cover the display electrode, and a protective layer formed on the dielectric layer; and a rear panel disposed facing the front panel so that discharge space is formed and including an address electrode formed in a direction intersecting the display electrode, and a barrier rib for partitioning the discharge space. The protective layer is formed by forming a base film made of MgO on the dielectric layer and attaching a plurality of aggregated particles obtained by aggregating a plurality of crystal particles of metal oxide to the base film so that the aggregated particles are distributed over an entire surface. The base film includes Si as a material impurity and a Si concentration in the base film is more than 0 ppm and not more than 10 ppm.

With such a configuration, a PDP having an improved electron emission property and an electric charge retention property, and capable of achieving a high image quality, low cost, and low voltage can be provided.

Furthermore, it is desirable that the Si concentration in the base film is not more than 5 ppm. With such a configuration, the electric charge retention property can be further improved.

Furthermore, it is desirable that the aggregated particles have an average particle diameter of not less than 0.9 μm and not more than 2 μm. With such a configuration, the electron emission property can be further improved.

REFERENCE MARKS IN THE DRAWINGS

Figure 1:
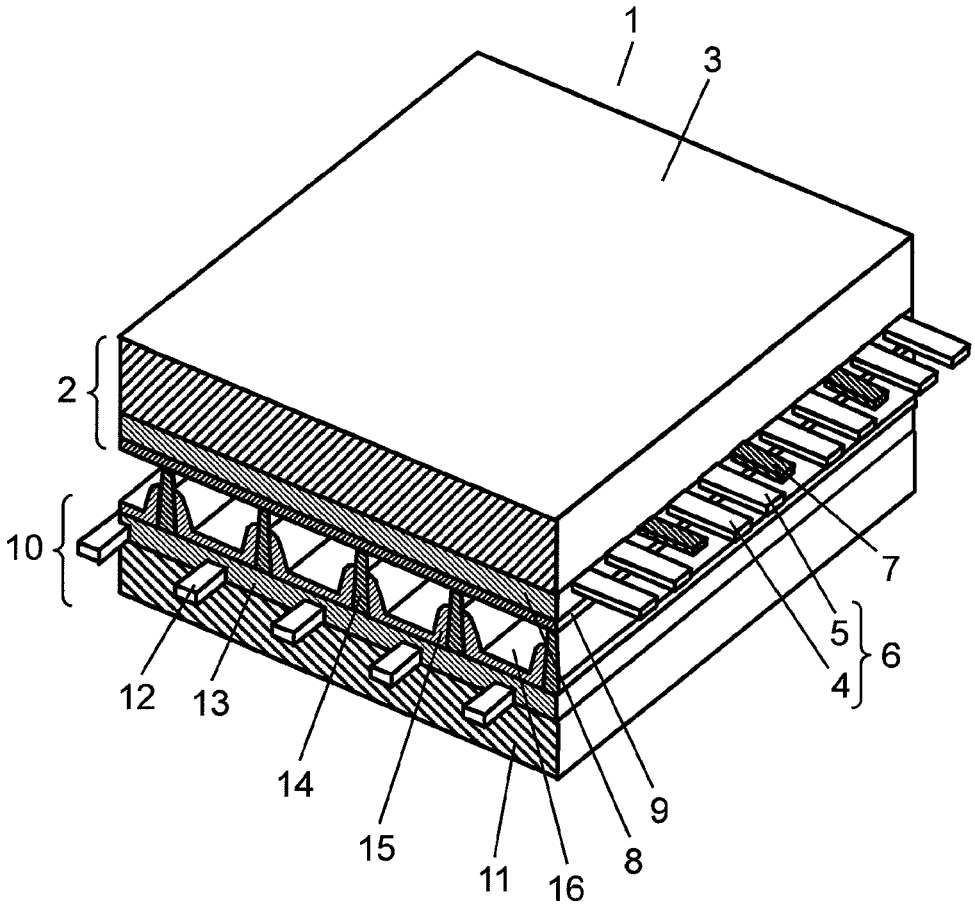
FIG. 1 is a perspective view showing a structure of a PDP in accordance with an exemplary embodiment of the present invention.

1 PDP
2 front panel
3 front glass substrate
4 scan electrode
4*a*, 5*a* transparent electrode
4*b*, 5*b* metal bus electrode
5 sustain electrode
6 display electrode
7 black stripe (light blocking layer)
8 dielectric layer
9 protective layer
10 rear panel
11 rear glass substrate
12 address electrode
13 base dielectric layer
14 barrier rib
15 phosphor layer
16 discharge space
81 first dielectric layer
82 second dielectric layer
91 base film
92 aggregated particles
92*a* crystal particle

DETAILED DESCRIPTION OF THE PREFERRED EMBODIMENTS

Hereinafter, a PDP in accordance with an exemplary embodiment of the present invention is described with reference to drawings.

Exemplary Embodiment

FIG. 1 is a perspective view showing a structure of a PDP in accordance with the exemplary embodiment of the present invention. The basic structure of the PDP is the same as that of a general AC surface-discharge type PDP. As shown in FIG. 1, PDP 1 includes front panel 2 including front glass substrate 3, and the like, and rear panel 10 including rear glass substrate 11, and the like. Front panel 2 and rear panel 10 are disposed facing each other and hermetically sealed together at the peripheries thereof with a sealing material made of a glass frit, and the like. In discharge space 16 inside the sealed PDP 1, discharge gas such as Ne and Xe is filled in at a pressure of 400 Torr to 600 Torr.

On front glass substrate 3 of front panel 2, plurality of band-like display electrodes 6 each composed of a pair of scan electrode 4 and sustain electrode 5 and black stripes (light blocking layers) 7 are disposed in parallel to each other. On glass substrate 3, dielectric layer 8 functioning as a capacitor is formed so as to cover display electrodes 6 and blocking layers 7. Furthermore, on the surface of dielectric layer 8, protective layer 9 made of, for example, magnesium oxide (MgO) is formed.

Furthermore, on rear glass substrate 11 of rear panel 10, a plurality of band-like address electrodes 12 are disposed in parallel to each other in the direction orthogonal to scan electrodes 4 and sustain electrodes 5 of front panel 2, and base dielectric layer 13 covers address electrodes 12. In addition, barrier ribs 14 with a predetermined height for partitioning discharge space 16 are formed between address electrodes 12 on base dielectric layer 13. In grooves between barrier ribs 14, every address electrode 12, phosphor layers 15 emitting red, green and blue light by ultraviolet ray are sequentially formed by coating. Discharge cells are formed in positions in which scan electrodes 4 and sustain electrodes 5 and address electrodes 12 intersect each other. The discharge cells having red, green and blue phosphor layers 15 arranged in the direction of display electrode 6 function as pixels for color display.

Figure 2:
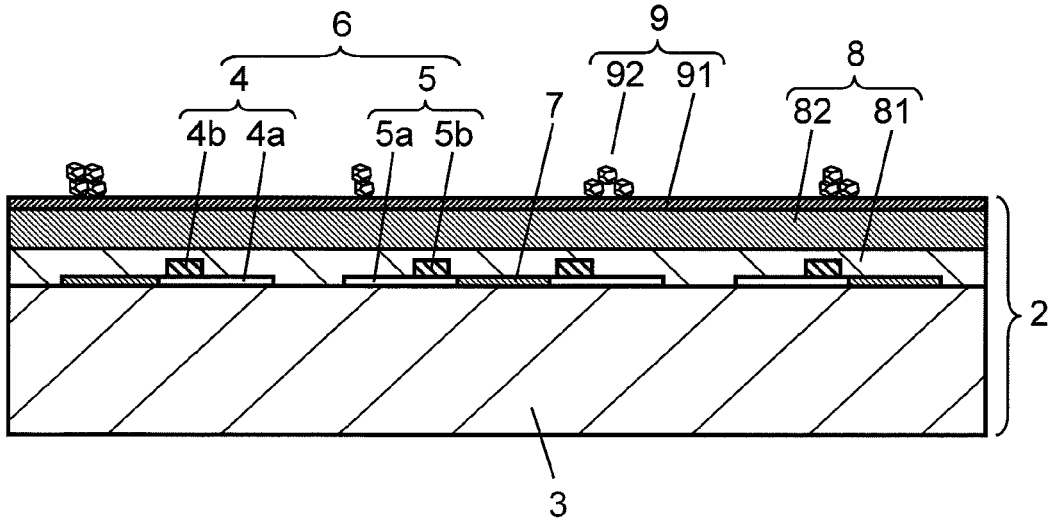
FIG. 2 is a sectional view showing a configuration of a front panel of the PDP.

FIG. 2 is a sectional view showing a configuration of front panel 2 of PDP 1 in accordance with an exemplary embodiment of the present invention. FIG. 2 is shown turned upside down with respect to FIG. 1. As shown in FIG. 2, display electrodes 6 each composed of scan electrode 4 and sustain electrode 5 and light blocking layers 7 are pattern-formed on front glass substrate 3 produced by, for example, a float method. Scan electrode 4 and sustain electrode 5 include transparent electrodes 4*a* and 5*a* made of indium tin oxide (ITO), tin oxide ($SnO_2$), or the like, and metal bus electrodes 4*b* and 5*b* formed on transparent electrodes 4*a* and 5*a*, respectively. Metal bus electrodes 4*b* and 5*b* are used for the purpose of providing the conductivity in the longitudinal direction of transparent electrodes 4*a* and 5*a* and formed of a conductive material containing a silver (Ag) material as a main component.

Dielectric layer 8 includes at least two layers, that is, first dielectric layer 81 and second dielectric layer 82. First dielectric layer 81 is provided for covering transparent electrodes 4*a* and 5*a*, metal bus electrodes 4*b* and 5*b* and light blocking layers 7 formed on front glass substrate 3. Second dielectric layer 82 is formed on first dielectric layer 81. In addition, protective layer 9 is formed on second dielectric layer 82. Protective layer 9 includes base film 91 formed on dielectric layer 8 and aggregated particles 92 attached to base film 91.

Next, a method of manufacturing a PDP is described. Firstly, scan electrodes 4, sustain electrodes 5 and light blocking layers 7 are formed on front glass substrate 3. Transparent electrodes 4*a* and 5*a* and metal bus electrodes 4*b* and 5*b* are formed by patterning by, for example, a photolithography method. Transparent electrodes 4*a* and 5*a* are formed by, for example, a thin film process. Metal bus electrodes 4*b* and 5*b* are formed by firing a paste containing a silver (Ag) material at a predetermined temperature so as to be solidified. Furthermore, light blocking layer 7 is similarly formed by a method of screen printing of paste containing a black pigment, or a method of forming a black pigment over the entire surface of the glass substrate, then carrying out patterning by a photolithography method, and firing thereof.

Next, a dielectric paste is coated on front glass substrate 3 by, for example, a die coating method so as to cover scan electrodes 4, sustain electrodes 5 and light blocking layer 7, thus forming a dielectric paste layer (dielectric material layer). After dielectric paste is coated, it is stood still for a predetermined time. Thus, the surface of the coated dielectric paste is leveled and flattened. Thereafter, the dielectric paste layer is fired and solidified, thereby forming dielectric layer 8 that covers scan electrode 4, sustain electrode 5 and light blocking layer 7. Note here that the dielectric paste is a coating material including a dielectric material such as glass powder, a binder and a solvent. Next, protective layer 9 made of magnesium oxide (MgO) is formed on dielectric layer 8 by vacuum evaporation method. From the above-mentioned steps, predetermined components (scan electrode 4, sustain electrode 5, light blocking layer 7, dielectric layer 8, and protective layer 9) are formed on front glass substrate 3. Thus, front panel 2 is completed.

On the other hand, rear panel 10 is formed as follows. Firstly, a material layer as components for address electrode 12 is formed on rear glass substrate 11 by, for example, a method of screen printing a paste including a silver (Ag) material, or a method of forming a metal film over the entire surface and then patterning it by a photolithography method. Then, the material layer is fired at a predetermined temperature. Thus, address electrode 12 is formed. Next, a dielectric paste is coated so as to cover address electrodes 12 by, for example, a die coating method on rear glass substrate 11 on which address electrode 12 is formed. Thus, a dielectric paste layer is formed. Thereafter, by firing the dielectric paste layer, base dielectric layer 13 is formed. Note here that a dielectric paste is a coating material including a dielectric material such as glass powder, a binder, and a solvent.

Next, by coating a barrier rib formation paste containing materials for barrier ribs on base dielectric layer 13 and patterning it into a predetermined shape, a barrier rib material layer is formed. Then, the barrier rib material layer is fired to form barrier ribs 14. Herein, a method of patterning the barrier rib formation paste coated on base dielectric layer 13 may include a photolithography method and a sand-blast method. Next, a phosphor paste containing a phosphor material is coated on base dielectric layer 13 between neighboring barrier ribs 14 and on the side surfaces of barrier ribs 14 and fired. Thereby, phosphor layer 15 is formed. With the above-mentioned steps, rear panel 10 having predetermined component members on rear glass substrate 11 is completed.

In this way, front panel 2 and rear panel 10, which include predetermined component members, are disposed facing each other so that scan electrodes 4 and address electrodes 12 are disposed orthogonal to each other, and sealed together at the peripheries thereof with a glass frit. Discharge gas including, for example, Ne and Xe, is filled in discharge space 16. Thus, PDP 1 is completed.

Herein, first dielectric layer 81 and second dielectric layer 82 constituting dielectric layer 8 of front panel 2 are described in detail. A dielectric material of first dielectric layer 81 includes the following material compositions: 20 wt. % to 40 wt. % of bismuth oxide ($Bi_2O_3$): 0.5 wt. % to 12 wt. % of at least one selected from calcium oxide (CaO), strontium oxide (SrO) and barium oxide (BaO); and 0.1 wt. % to 7 wt. % of at least one selected from molybdenum oxide ($MoO_3$), tungsten oxide ($WO_3$), cerium oxide ($CeO_2$), and manganese oxide ($MnO_2$).

Instead of molybdenum oxide ($MoO_3$), tungsten oxide ($WO_3$), cerium oxide ($CeO_2$) and manganese oxide ($MnO_2$), 0.1 wt. % to 7 wt. % of at least one selected from copper oxide (CuO), chromium oxide ($Cr_2O_3$), cobalt oxide ($Co_2O_3$), vanadium oxide ($V_2O_7$) and antimony oxide ($Sb_2O_3$) may be included.

Furthermore, as components other than the components mentioned above, a material composition that does not include a lead component, for example, 0 wt. % to 40 wt. % of zinc oxide (ZnO), 0 wt. % to 35 wt. % of boron oxide ($B_2O_3$), 0 wt. % to 15 wt. % of silicon oxide ($SiO_2$) and 0 wt. % to 10 wt. % of aluminum oxide ($Al_2O_3$) may be contained. The contents of such material compositions are not particularly limited, and the contents of material compositions may be around the range of that in conventional technologies.

The dielectric materials including these composition components are ground to have an average particle diameter of 0.5 μm to 2.5 μm by using a wet jet mill or a ball mill to form dielectric material powder. Then, 55 wt % to 70 wt % of the dielectric material powders and 30 wt % to 45 wt % of binder components are well kneaded by using three rolls to form a paste for the first dielectric layer to be used in die coating or printing.

The binder component is ethylcellulose, or terpineol containing 1 wt % to 20 wt % of acrylic resin, or butyl carbitol acetate. Furthermore, in the paste, if necessary, at least one of dioctyl phthalate, dibutyl phthalate, triphenyl phosphate and tributyl phosphate may be added as a plasticizer; and at least one of glycerol monooleate, sorbitan sesquioleate, Homogenol (Kao Corporation), an alkylallyl phosphate, and the like may be added as a dispersing agent, so that the printing property may be improved.

Then, this first dielectric layer paste is printed on front glass substrate 3 by a die coating method or a screen printing method so as to cover display electrodes 6 and dried, followed by firing at a temperature of 575° C. to 590° C., that is, a slightly higher temperature than the softening point of the dielectric material.

Next, second dielectric layer 82 is described. A dielectric material of second dielectric layer 82 includes the following material compositions: 11 wt. % to 20 wt. % of bismuth oxide ($Bi_2O_3$); furthermore, 1.6 wt. % to 21 wt. % of at least one selected from calcium oxide (CaO), strontium oxide (SrO), and barium oxide (BaO); and 0.1 wt. % to 7 wt. % of at least one selected from molybdenum oxide ($MoO_3$), tungsten oxide ($WO_3$), and cerium oxide ($CeO_2$).

Instead of molybdenum oxide ($MoO_3$), tungsten oxide ($WO_3$) and cerium oxide ($CeO_2$), 0.1 wt. % to 7 wt. % of at least one selected from copper oxide (CuO), chromium oxide ($Cr_2O_3$), cobalt oxide ($Co_2O_3$), vanadium oxide ($V_2O_7$), antimony oxide ($Sb_2O_3$) and manganese oxide ($MnO_2$) may be included.

Furthermore, as components other than the above-mentioned components, a material composition that does not include a lead component, for example, 0 wt. % to 40 wt. % of zinc oxide (ZnO), 0 wt. % to 35 wt. % of boron oxide ($B_2O_3$), 0 wt. % to 15 wt. % of silicon oxide ($SiO_2$) and 0 wt. % to 10 wt. % of aluminum oxide ($Al_2O_3$) may be contained. The contents of such material compositions are not particularly limited, and may be in the range of the contents in conventional technologies.

The dielectric materials including these composition components are ground to have an average particle diameter of 0.5 to 2.5 μm by using a wet jet mill or a ball mill to form dielectric material powder. Then, 55 wt % to 70 wt % of the dielectric material powders and 30 wt % to 45 wt % of binder component are well kneaded by using three rolls to form a paste for a second dielectric layer to be used in die coating or printing. The binder component is ethylcellulose, or terpineol containing 1 wt % to 20 wt % of acrylic resin, or butyl carbitol acetate. Furthermore, in the paste, if necessary, dioctyl phthalate, dibutyl phthalate, triphenyl phosphate and tributyl phosphate may be added as a plasticizer, glycerol monooleate, sorbitan sesquioleate, Homogenol (Kao Corporation), an alkylallyl phosphate, and the like, may be added as a dispersing agent, so that the printing property may be improved.

Next, this second dielectric layer paste is printed on first dielectric layer 81 by a screen printing method or a die coating method and dried, followed by firing at a temperature of 550° C. to 590° C., that is, a slightly higher temperature than the softening point of the dielectric material.

Note here that it is preferable that the film thickness of dielectric layer 8 in total of first dielectric layer 81 and second dielectric layer 82 is not more than 41 μm in order to secure the visible light transmittance. The content of bismuth oxide ($Bi_2O_3$) of first dielectric layer 81 is set to be 20 wt % to 40 wt %, which is higher than the content of bismuth oxide in second dielectric layer 82, in order to suppress the reaction between metal bus electrodes 4*b* and 5*b* and silver (Ag). Therefore, since the visible light transmittance of first dielectric layer 81 becomes lower than that of second dielectric layer 82, the film thickness of first dielectric layer 81 is set to be thinner than that of second dielectric layer 82.

It is not preferable that the content of bismuth oxide ($Bi_2O_3$) is not more than 11 wt % in second dielectric layer 82 because bubbles tend to be generated in second dielectric layer 82 although coloring does not easily occur. Furthermore, it is not preferable that the content is more than 40 wt % for the purpose of increasing the transmittance because coloring tends to occur.

As the film thickness of dielectric layer 8 is smaller, the effect of improving the panel brightness and reducing the discharge voltage is more remarkable. Therefore, it is desirable that the film thickness is set to be as small as possible within a range in which withstand voltage is not reduced. From the viewpoint of this, in an exemplary embodiment of the present invention, the film thickness of dielectric layer 8 is set to be not more than 41 μM, that of first dielectric layer 81 is set to be 5 μm to 15 μm, and that of second dielectric layer 82 is set to be 20 μm to 36 μm.

In the thus manufactured PDP, it is confirmed that even when a silver (Ag) material is used for display electrode 6, less coloring phenomenon (yellowing) of front glass substrate 3 occurs, and that dielectric layer 8 in which less bubbles are generated and which is excellent in withstand voltage performance can be realized.

Next, in the PDP in accordance with an exemplary embodiment of the present invention, the reason why these dielectric materials suppress the generation of yellowing or bubbles in first dielectric layer 81 is considered. That is to say, it is known that by adding molybdenum oxide ($MoO_3$) or tungsten oxide ($WO_3$) to dielectric glass containing bismuth oxide ($Bi_2O_3$), compounds such as $Ag_2MoO_4$, $Ag_2Mo_2O_7$, $Ag_2Mo_4O_{13}$, $Ag_2WO_4$, $Ag_2W_2O_7$, and $Ag_2W_4O_{13}$ are easily generated at such a low temperature as not higher than 580° C. In an exemplary embodiment of the present invention, since the firing temperature of dielectric layer 8 is 550° C. to 590° C., silver ions ($Ag^+$) dispersing in dielectric layer 8 during firing are reacted with molybdenum oxide ($MoO_3$), tungsten oxide ($WO_3$), cerium oxide ($CeO_2$), and manganese oxide ($MnO_2$) in dielectric layer 8 so as to generate a stable compound and be stabilized. That is to say, since silver ions ($Ag^+$) are stabilized without being reduced, they do not aggregate to form a colloid. Therefore, the stabilization of silver ions ($Ag^+$) decreases the generation of oxygen accompanying the formation of colloid of silver (Ag). Therefore, the generation of bubbles in dielectric layer 8 is reduced.

On the other hand, in order to make these effects be effective, it is preferable that the content of molybdenum oxide ($MoO_3$), tungsten oxide ($WO_3$), cerium oxide ($CeO_2$), and manganese oxide ($MnO_2$) in the dielectric glass containing bismuth oxide ($Bi_2O_3$) is not less than 0.1 wt. %. It is more preferable that the content is not less than 0.1 wt. % and not more than 7 wt. %. In particular, it is not preferable that the content is less than 0.1 wt. % because the effect of suppressing yellowing is reduced. Furthermore, it is not preferable that the content is more than 7 wt. % because coloring occurs in the glass.

That is to say, in dielectric layer 8 of PDP in accordance with an exemplary embodiment of the present invention, the generation of yellowing phenomenon and bubbles are suppressed in first dielectric layer 81 that is brought into contact with metal bus electrodes 4*b* and 5*b* made of silver (Ag) material, and high light transmittance is realized by second dielectric layer 82 formed on first dielectric layer 81. As a result, it is possible to realize a PDP in which dielectric layer 8 as a whole has extremely reduced generation of bubbles or yellowing and has high transmittance.

Next, a configuration and a manufacturing method of a protective layer that is the feature of the present invention, are described.

Figure 3:
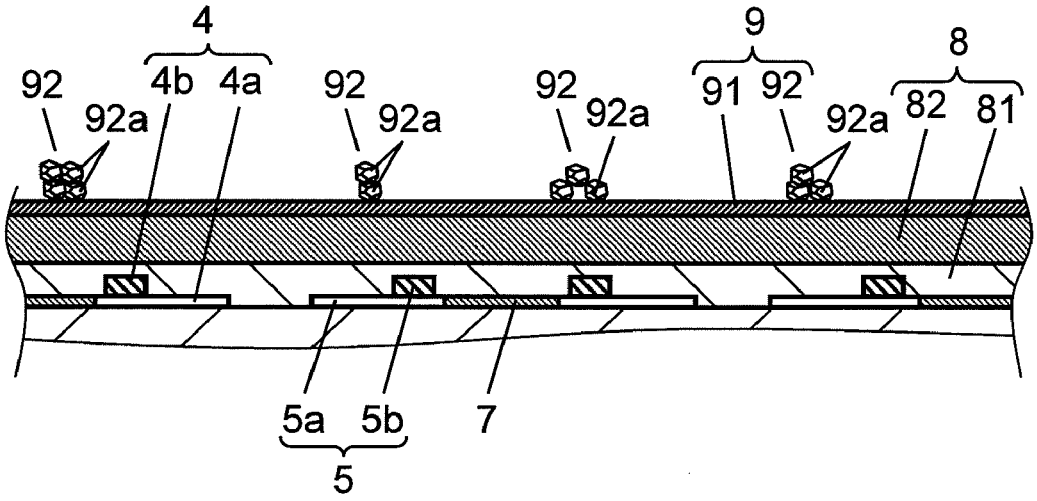
FIG. 3 is an enlarged view illustrating a protective layer part of the PDP.

FIG. 3 is an enlarged view illustrating a protective layer part of the PDP in accordance with an exemplary embodiment of the present invention. As shown in FIG. 3, protective layer 9 includes base film 91 and aggregated particles 92. Base film 91, which is made of MgO containing Si as an impurity, is formed on dielectric layer 8. A plurality of aggregated particles 92 obtained by aggregating a plurality of crystal particles 92*a* of MgO as metal oxide are discretely scattered on base film 91 so that aggregated particles 92 are distributed over the entire surface substantially uniformly.

Figure 4:
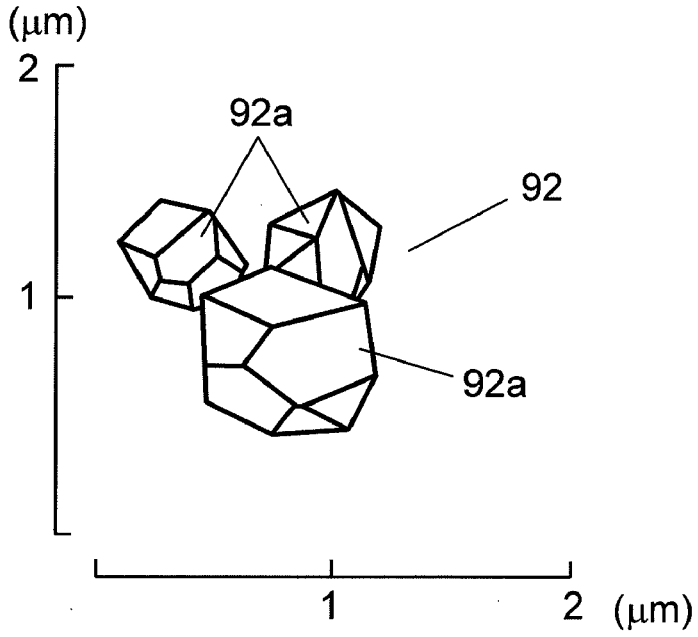
FIG. 4 is an enlarged view illustrating aggregated particles in the protective layer of the PDP.

Herein, aggregated particle 92 is a state in which crystal particles 92*a* having a predetermined primary particle diameter are aggregated or necked as shown in FIG. 4. In aggregated particle 92, a plurality of primary particles are not bonded to each other as a solid with a large bonding strength but combined as an assembly structure by static electricity, Van der Waals force, or the like. That is to say, a part or all of crystal particles 92*a* are combined by an external stimulation such as ultrasonic wave to a degree that they are in a state of primary particles. The particle diameter of aggregated particles 92 is about 1 μm. It is desirable that crystal particle 92*a* has a shape of polyhedron having seven faces or more, for example, truncated octahedron and dodecahedron.

Furthermore, the primary particle diameter of crystal particle 92*a* of MgO can be controlled by the production condition of crystal particle 92*a*. For example, when crystal particle 92*a* of MgO is produced by firing an MgO precursor such as magnesium carbonate or magnesium hydroxide, the particle diameter can be controlled by controlling the firing temperature or firing atmosphere. In general, the firing temperature can be selected in the range from about 700° C. to about 1500° C. When the firing temperature is set to be relatively high temperature such as 1000° C. or more, the primary particle diameter can be controlled to about 0.3 μm to 2 μm. Furthermore, crystal particle 92*a* can be obtained by heating an MgO precursor. In this process, it is possible to obtain aggregated particles 92 in which a plurality of primary particles are combined by aggregation or a phenomenon called necking during production process.

Next, results of experiments carried out in order to confirm the effect of the PDP having the protective layer in accordance with the present invention is described. In an exemplary embodiment of the present invention, PDPs including protective layers having different configurations are made as trial products and the trial products are examined for the electron emission property and the electric charge retention property. Trial product 1 is a PDP including only a protective layer made of MgO. Trial product 2 is a PDP including a protective layer made of MgO doped with impurities such as Al and Si. Trial product 3 is a PDP in which a plurality of aggregated particles obtained by a plurality of aggregating crystal particles are attached to a base film made of MgO so that the aggregated particles are distributed over the entire surface of the base film substantially uniformly. Trial product 4 is a PDP having a configuration in which the amount of impurities in the base film of trial product 3 is controlled, which is a PDP in accordance with an exemplary embodiment of the present invention.

PDPs having these four kinds of configurations of protective layers are examined for the electron emission performance and the electric charge retention performance.

Note here that the larger the electron emission performance is, the larger the amount of emitted electrons is. The electron emission performance is expressed by the initial electron emission amount determined by the surface state by discharge, kinds of gases and the state thereof. The initial electron emission amount can be measured by irradiating the surface with ions or electron beams and then measuring the amount of electron current emitted from the surface. However, it is difficult to evaluate the front panel surface in a nondestructive way. Therefore, as described in Japanese Patent Unexamined Publication No. 2007-48733, the value called a statistical lag time among lag times at the time of discharge, which is an index showing the discharging tendency, is measured. By integrating the inverse number of the numeric value, a numeric value linearly corresponding to the initial electron emission amount is obtained. Herein, this obtained value is used so as to evaluate the electron emission amount. This lag time at the time of discharge means a time of discharge delay (hereinafter, referred to as "Ts") in which discharge is delayed from the time of pulse rising. The main factor of this discharge delay (Ts) is thought to be that the initial electron functioning as a trigger is not easily emitted from a protective layer surface to discharge space when discharge is started.

Furthermore, the charge retention performance uses, as the index thereof, a value of a voltage applied to a scan electrode (hereinafter, referred to as "Vscn lighting voltage"), which is necessary to suppress the phenomenon of releasing electric charge when the PDP is manufactured. That is to say, it is shown that when Vscn lighting voltage is lower, the charge retention performance is higher. This is advantageous because driving at a low voltage is possible in designing of a panel of a PDP when Vscn lighting voltage is low. That is to say, as a power supply or electrical components of a PDP, components having a withstand voltage and a small capacity can be used. In current products, as semiconductor switching elements such as MOSFET for applying a scanning voltage to a panel sequentially, an element having a withstand voltage of about 150 V is used. Therefore, it is desirable that the Vscn lighting voltage is suppressed to not more than 120 V in the environment at 70° C. with considering the fluctuation due to temperatures.

Figure 5:
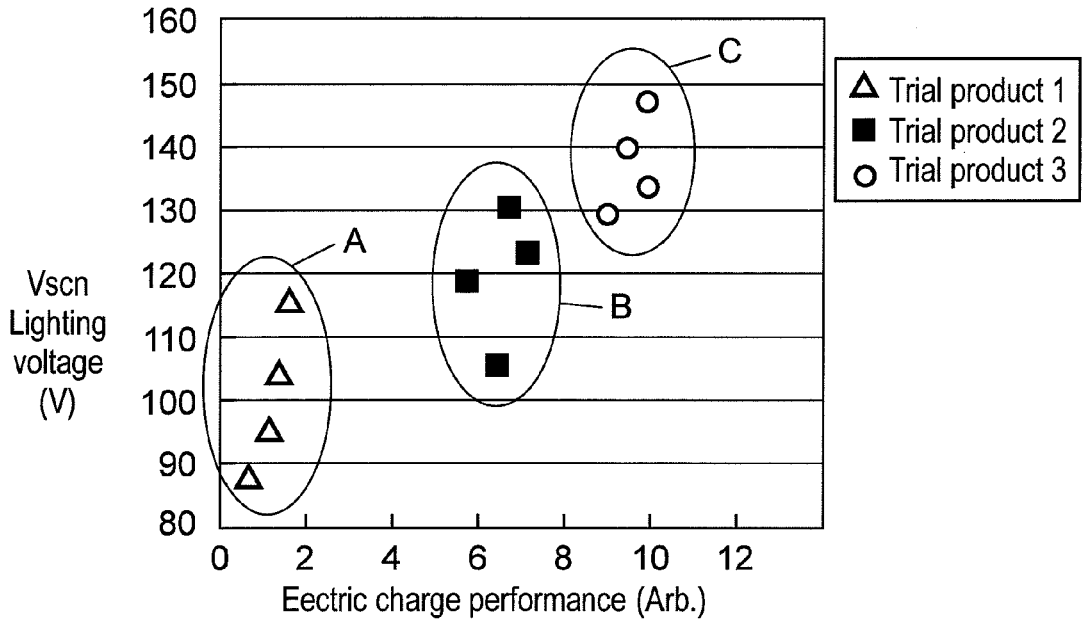
FIG. 5 is a graph showing results of the electron emission performance and the electric charge retention performance depending upon the configuration of the protective layer.

FIG. 5 is a graph showing results of the electron emission performance and the electric charge retention performance depending upon the configuration of the protective layer. The abscissa of FIG. 5 shows the measurement results of an electron current amount as the electron emission performance, showing the results based on a value that is larger next to the minimum value of trial product 1. Furthermore, the ordinate shows the above-mentioned Vscn lighting voltage. As shown in FIG. 5, characteristic values are divided into groups of trial products 1, 2 and 3, respectively.

That is to say, in conventional PDPs of trial product 1 including only a protective layer made of MgO, the electron emission performance is low but the electric charge retention property is excellent as shown in group A. In PDPs of trial product 2 including a protective layer made of MgO doped with impurities such as Al and Si, the electron emission performance is high but the electric charge retention property is reduced as shown in group B. In PDPs of trial product 3 in which a plurality of aggregated particles obtained by a plurality of aggregating crystal particles are attached to a base film made of MgO so that the aggregated particles are distributed over the entire surface substantially uniformly, the electron emission performance is especially improved but the electric charge retention property is extremely reduced as shown in group C. Therefore, it is shown that any of PDPs of trial products 1 to 3 do not satisfy both the electron emission performance and the electric charge retention property.

Thus, as a configuration of the protective layer satisfying both the electron emission performance and the electric charge retention property, the present invention focuses on the amount of impurities contained in the base film and focuses on the configuration of the protective layer in which the amount of specific impurities is specified in group B in FIG. 5 and in which a plurality of aggregated particles obtained by a plurality of aggregating crystal particles are attached to the base film so that the aggregated particles are distributed over the entire surface of the base film substantially uniformly in group C. That is to say, in the protective layer in accordance with an exemplary embodiment of the present invention, a base film made of MgO is formed on the dielectric layer, a plurality of aggregated particles obtained by aggregating a plurality of crystal particles made of metal oxide are attached to the base film so that the aggregated particles are distributed over the entire surface of the base film, and the Si concentration in the base film is set to not more than 10 ppm.

Figure 6:
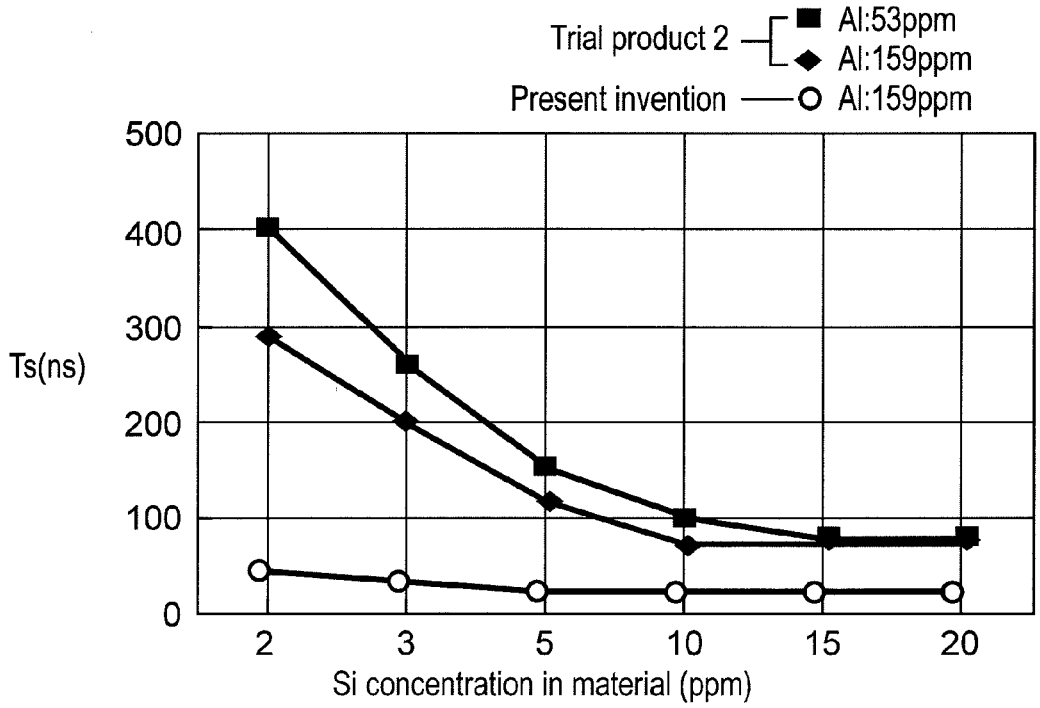
FIG. 6 is a graph showing a relation between a Si concentration in a base film and a discharge delay (Ts) as the electron emission property in a PDP in accordance with an exemplary embodiment of the present invention.
Figure 7:
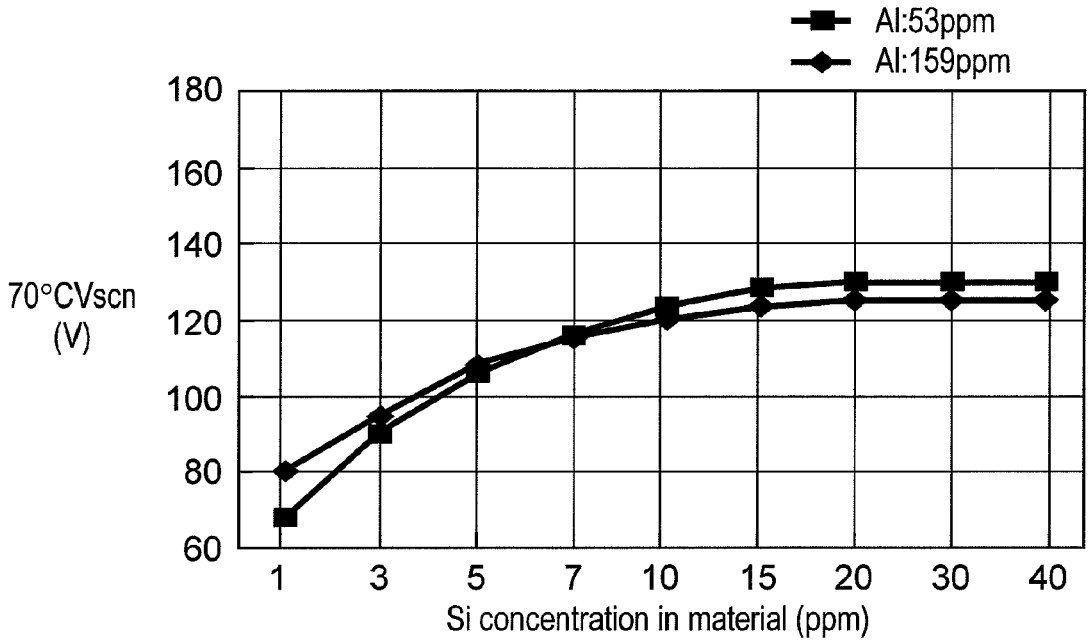
FIG. 7 is a graph showing a relation between a Si concentration in the base film and a Vscn lighting voltage in an environment at 70° C. as the electric charge retention property in the PDP.

FIG. 6 is a graph showing a relation between a Si concentration in the base film and a discharge delay (Ts) as the electron emission property in a PDP including a protective layer having the above-mentioned configuration in accordance with an exemplary embodiment of the present invention. FIG. 6 shows a discharge delay (Ts) as an electron emission property of trial product 4 (the present invention). FIG. 6 also shows a property of trial product 2 when an Al concentration in the base film is changed in the protective layer including only a base film. FIG. 7 is a graph showing a relation between a Si concentration in the base film and a Vscn lighting voltage in the environment at 70° C. as the electric charge retention property.

As shown in FIG. 6, as to the discharge delay (Ts) as the electron emission property, a PDP having a protective layer in accordance with an exemplary embodiment of the present invention has small discharge delay (Ts) regardless of the Si concentration in the base film, showing that the electron emission property is excellent. On the other hand, in trial product 2 having a configuration in which a protective layer that does not have aggregated particles is formed on the base film, as the increase in the Si concentration regardless of the Al concentration, the discharge delay (Ts) becomes smaller and the electron emission property is improved.

On the other hand, as shown in FIG. 7, in the configuration of the protective layer of the PDP in accordance with an exemplary embodiment of the present invention, a Vscn lighting voltage as the electric charge retention property is changed according to the Si concentration. Furthermore, in this case, it is shown that the Vscn lighting voltage does not depend upon the Al concentration of the base film. Furthermore, from FIG. 7, when the Si concentration is more than 10 ppm, Vscn lighting voltage becomes substantially saturated. As mentioned above, the Vscn lighting voltage can be set to not more than 120 V.

Therefore, in a configuration of the protective layer for reducing the Vscn lighting voltage as an electric charge retention property, a base film made of MgO is formed and a plurality of aggregated particles obtained by aggregating a plurality of crystal particles made of metal oxide are formed on the base film made of MgO so that the aggregated particles are distributed over the entire surface. In addition, the Si concentration in the base film may be not more than 10 ppm. Furthermore, in order to make the Vscn lighting voltage not more than 100 V, it is desirable that the Si concentration in the base film is not more than 5 ppm.

Therefore, in the PDP having a configuration of a protective layer in accordance with an exemplary embodiment of the present invention, as shown in FIG. 5, a PDP having the electron emission performance of not less than 6 and Vscn lighting voltage as the electric charge retention performance of not more than 120 V can be obtained. Furthermore, in a protective layer of a PDP in which the number of scan lines tends to increase and the cell size tends to be smaller with the high definition, both the electron emission performance and the charge retention performance can be satisfied.

Note here that the lower limit value of the Si concentration in the base film is more than 0 ppm. That is to say, the base film includes Si as a material impurity and shows a measurement limit value of analytical measurement.

Figure 8:
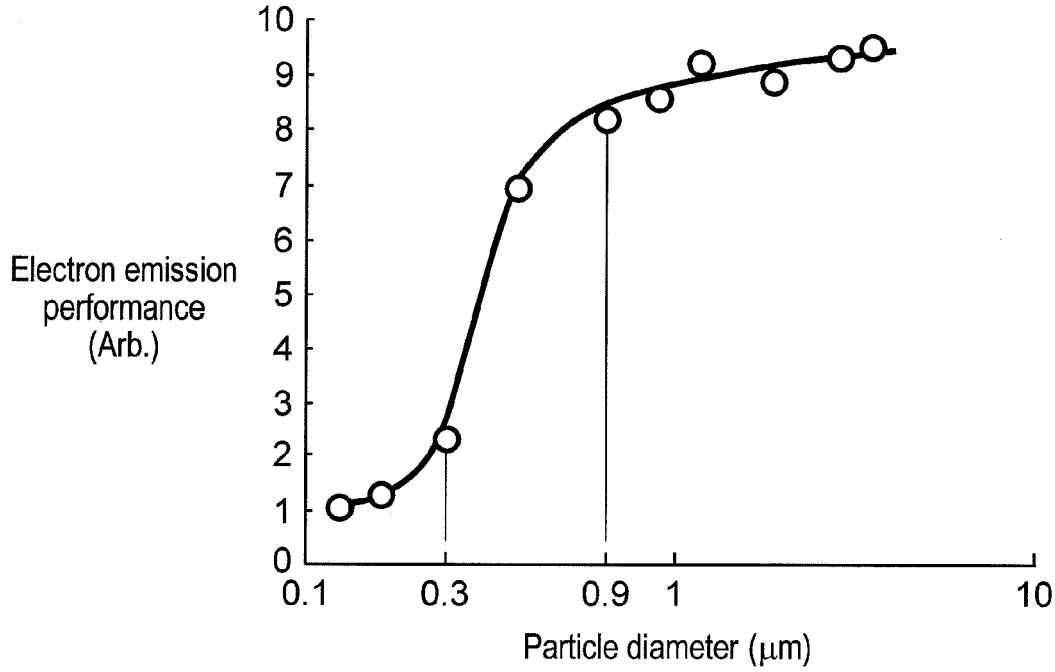
FIG. 8 is a graph showing the result of experiment for examining the electron emission performance when the crystal particle diameter of MgO in the PDP is changed.

Next, the particle diameter of crystal particles used in a protective layer of a PDP in accordance with an exemplary embodiment of the present invention is described. In the below-mentioned description, the particle diameter denotes an average particle diameter, and the average particle diameter denotes a volume cumulative mean diameter (D50). FIG. 8 is a graph showing the result of experiment for examining the electron emission performance when the crystal particle diameter of MgO in the PDP is changed. In FIG. 8, the particle diameter of the crystal particle of MgO is measured by SEM observation of the crystal particles.

As shown in FIG. 8, it is shown that when the particle diameter is reduced to about 0.3 μm, the electron emission performance is reduced, and that when the particle diameter is substantially not less than 0.9 μm, high electron emission performance can be obtained.

In order to increase the number of emitted electrons in the discharge cell, it is desirable that the number of crystal particles per unit area on the base film is large. On the other hand, however, according to the experiment by the present inventors, when crystal particles exist in a portion corresponding to the top portion of the barrier rib of the rear panel that is in close contact with the protective layer of the front panel, the top portion of the barrier rib may be damaged. The material may be put on a phosphor, causing a phenomenon that the corresponding cell is not normally turned on and off. The phenomenon that a barrier rib is damaged can be suppressed if crystal particles do not exist on the top portion corresponding to the barrier rib. Therefore, when the number of crystal particles to be attached is increased, the damage occurrence rate of the barrier rib is increased.

Figure 9:
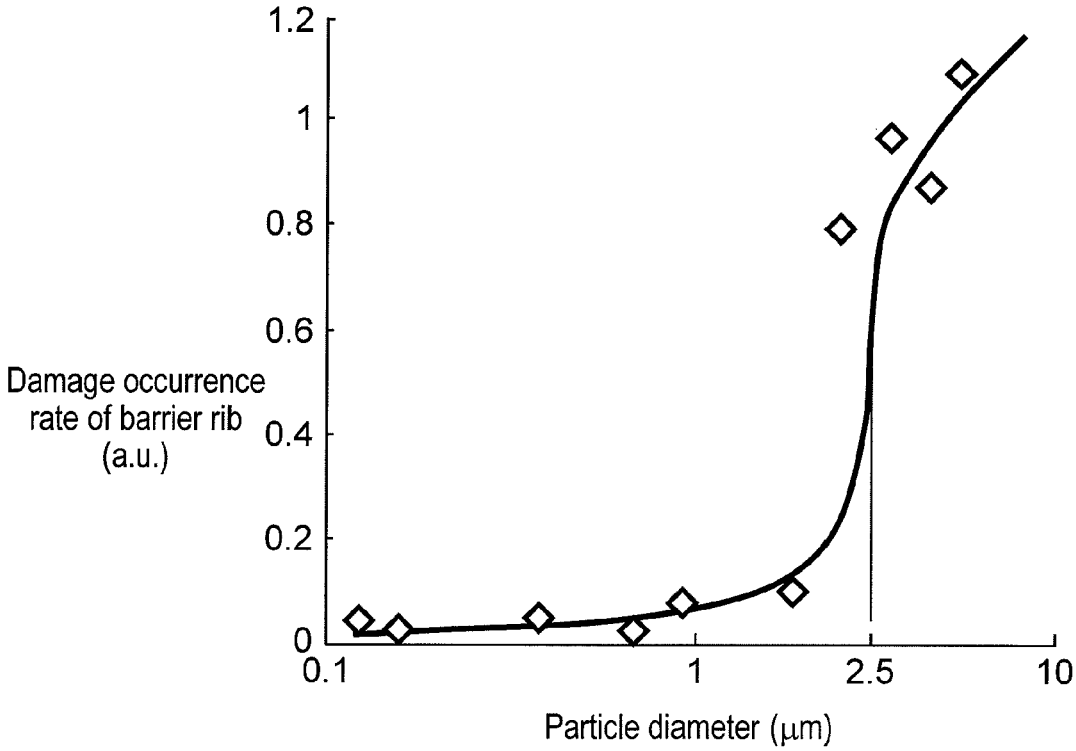
FIG. 9 is a graph showing a relation between the particle diameter of the crystal particle and the damage occurrence rate of the barrier rib in the PDP.

FIG. 9 is a graph showing a relation between the particle diameter and the damage occurrence rate of barrier ribs in which the same number of crystal particles having different particle diameters are scattered per unit area in PDP described in FIG. 7 in accordance with an exemplary embodiment of the present invention. As is apparent from FIG. 9, it is shown that when the crystal particle diameter is increased to about 2.5 μm, the damage occurrence rate of the barrier rib rapidly rises but that when the crystal particle diameter is less than 2.5 the damage occurrence rate of the barrier rib can be suppressed to relatively small.

Based on the above-mentioned results, it is thought to be desirable that the protective layer of the PDP in accordance with an exemplary embodiment of the present invention includes crystal particles having a particle diameter of not less than 0.9 μm and not more than 2.5 μm. However, in actual mass production of PDPs, variation in manufacturing crystal particles or variation in forming protective layers need to be considered.

In order to consider the factors of variation in manufacturing, experiments using crystal particles having different particle size distributions are carried out. As a result, it is shown that when aggregated particles having an average particle diameter of not less than 0.9 μm and not more than 2 μm are used, the above-mentioned effect of the present invention can be obtained stably.

As mentioned above, as a PDP including the protective layer of the present invention, a PDP including a protective layer having the electron emission performance of not less than 6 and Vscn lighting voltage as the charge retention performance of not more than 120 V can be obtained. Therefore, in a protective layer of a PDP in which the number of scan lines tends to increase and the cell size tends to be smaller with the high definition, both the electron emission performance and the charge retention performance can be satisfied. Thus, a PDP having a high definition and high brightness display performance, and low electric power consumption can be realized.

In the above description, a case in which a base film including MgO as a main component is used is described as an example. However, for a configuration in which the electron emission performance is dominantly controlled by single crystal particles of metal oxide, MgO is not necessarily used. Other materials such as $Al_2O_3$ having an excellent shock resistance property may be used. In the description of this exemplary embodiment, as single crystal particles, MgO particles are used. However, since the same effect can be obtained even when other single crystal particles of oxide of metal such as Sr, Ca, Ba, and Al having high electron emission performance similar to MgO are used, the kinds of particles are not limited to MgO.

INDUSTRIAL APPLICABILITY

As mentioned above, the present invention is useful in realizing a PDP having high definition and high brightness display performance and low electric power consumption.

The invention claimed is:

1. A plasma display panel comprising:

a front panel including:

a substrate;

a display electrode formed on the substrate;

a dielectric layer formed so as to cover the display electrode; and a protective layer formed on the dielectric layer; and a rear panel disposed facing the front panel, such that a discharge space is formed between the front panel and the rear panel, the rear panel including an address electrode formed in a direction intersecting the display electrode, and including a barrier rib partitioning the discharge space, wherein the protective layer is formed by forming a base film made of MgO on the dielectric layer and by attaching a plurality of groups of aggregated particles to the base film, such that each respective group of the plurality of groups of aggregated particles is discrete from other groups of the plurality of groups of aggregated particles, such that each respective group of the plurality of groups of aggregated particles includes a plurality of crystal particles of metal oxide, and such that the plurality of groups of aggregated particles is discretely located over an entire surface of the base film, wherein the base film includes Si as a material impurity, such that a Si concentration in the base film is more than 0 ppm and not more than 10 ppm, wherein each group of aggregated particles of the plurality of groups of aggregated particles is (i) in a lump form and (ii) comprises a plurality of metal oxide crystal particles piled up to form the lump form, wherein each group of aggregated particles of the plurality of groups of aggregated particles is located discretely over a surface of the base film of the protective layer, and wherein each respective group of aggregated particles of the plurality of groups of aggregated particles has an average particle diameter of not less than 0.9 μm and not more than 2 μm.

2. The plasma display panel of claim 1, wherein the Si concentration in the base film is not more than 5 ppm.

* * * * *